US005269361A

United States Patent [19]

Ryden et al.

[11] Patent Number: 5,269,361

[45] Date of Patent: Dec. 14, 1993

[54] SLAT FOR A WINDOW BLIND

[75] Inventors: Lee N. Ryden, 7094 Cedarbank, West Bloomfield, Mich. 48234; John A. Dixon, 2340 Exline Cir., Hudson, Ohio 44236

[73] Assignees: John Dixon, Twinsburg, Ohio; Lee Ryden, Keego Harbor, Mich.

[21] Appl. No.: 966,697

[22] Filed: Oct. 26, 1992

[51] Int. Cl.[5] ..... E06B 3/06

[52] U.S. Cl. ..... 160/236; 160/900

[58] Field of Search ..... 160/236, 900, 166.1, 160/178.1; 156/17

[56] References Cited

U.S. PATENT DOCUMENTS

| | | | |
|---|---|---|---|
| 2,090,145 | 8/1937 | Pierce | 156/17 |
| 2,142,629 | 1/1939 | Clark, Jr. | 156/17 |
| 2,156,163 | 4/1939 | Pierce | 156/17 |
| 4,049,038 | 9/1977 | Hyman et al. | 160/166 |
| 4,434,834 | 3/1984 | Ennes | 160/166 |
| 4,475,579 | 10/1984 | Bassett | 160/178 |
| 4,628,980 | 12/1986 | Le Houillier | 160/900 X |
| 4,842,036 | 6/1989 | Goodman | 160/166.1 |

*Primary Examiner*—Blair M. Johnson

*Attorney, Agent, or Firm*—Brooks & Kushman

[57] ABSTRACT

A slat for a vertical blind is disclosed. The slat comprises a backing, an end piece, and a decorative insert. The side flange is disposed along each side edge of the backing, and extends inwardly over a front side of the backing. An end flange is similarly integrally connected to the end piece and extends inwardly over an end edge of the backing. An opaque strip is disposed along each side flange, and an opaque strip is disposed along the end flange. A decorative insert is held against the backing by the flanges.

19 Claims, 1 Drawing Sheet

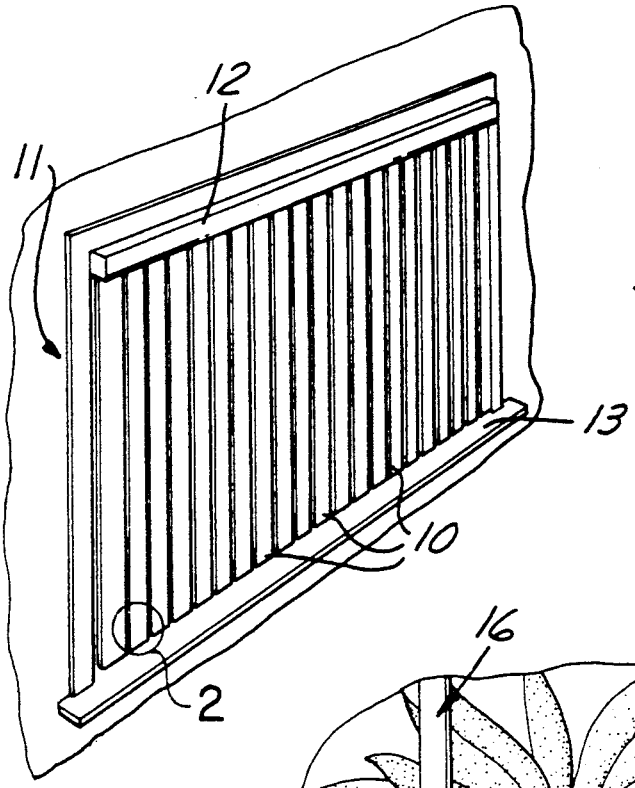
FIG. 1
FIG. 2
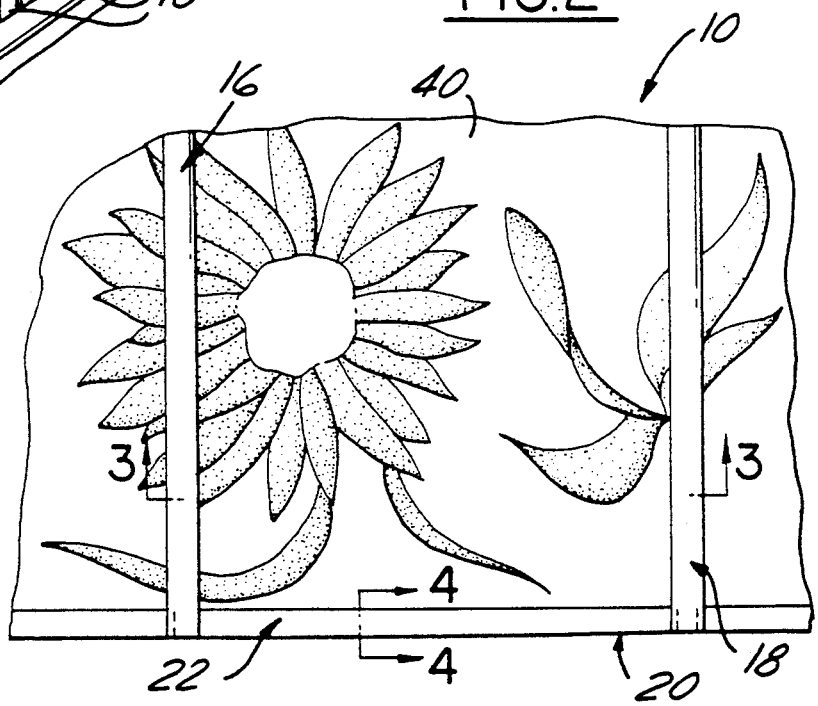
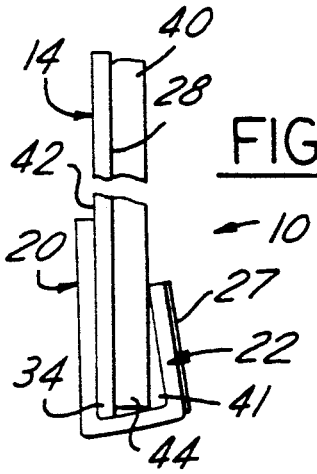
FIG. 4
FIG. 3
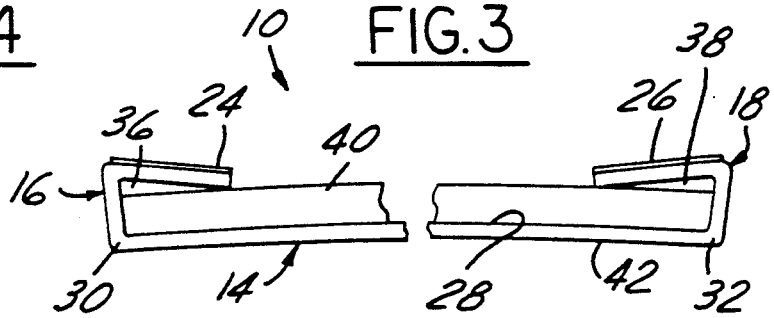

SLAT FOR A WINDOW BLIND

TECHNICAL FIELD

The present invention relates to slats for window blinds. More specifically, the present invention relates to a window blind slat which includes a pair of side flanges and an end flange for retaining a section of decorative fabric and preventing the section from fraying.

BACKGROUND ART

Decorators have often chosen louvered coverings to cover windows and doors. For aesthetic and functional reasons, some decorators choose to use a vertical window blind system having a series of slats and a slat support instead of conventional Venetian blinds. In the past, such vertical blind slats were often painted or otherwise coated to match the building and room decor. When the room decor was changed, however, the painted slats had to be repainted or discarded.

Several vertical blind slats have been developed which allow a section of decorative material to be removably attached to the slat. Because the individual sections of material can thus be replaced when necessary, the overall appearance of the vertical blind is likewise easily changed. The decorative material often includes a strip of paper or fabric, and several types of vertical blind slats have been specifically developed for accommodating these types of materials. However, several problems have been encountered in these improved slats as well.

One example of a blind slat with an interchangeable decorative material is disclosed in U.S. Pat. No. 2,142,629 to Clark, Jr. Clark, Jr. discloses a rectangular-shaped frame for use with a conventional Venetian blind. The frame has a U-shaped cross-section which forms a channel that can hold a decorative insert. The insert itself is constructed of paper or cardboard and is enclosed within a transparent or translucent material. In this type of construction, the insert is supported only on its outer edges by the frame, leaving the center portion of the insert relatively unsupported. This allows possible sagging of the insert to occur. Furthermore, the transparent or translucent material enclosing the insert can hide the surface texture of the insert and detract from its appearance.

Other constructions of a slat for a vertical blind are disclosed in U.S. Pat. No. 4,049,038 to Hyman et al. and U.S. Pat. No. 4,842,036 to Goodman. Both of these references disclose vertical blind slats having an elongate panel and a decorative laminate secured onto the panel. The panel is constructed from a rigid material and has inwardly extending flanges along each side edge. The flanges form a wide, low channel capable of receiving the laminate. Since the flanges run only along the side edges of the panel, the bottom edge is left unprotected. Because vertical blinds normally reach all the way to the floor or window sill for aesthetic reasons, the bottom edge of the decorative laminate may fray when it rubs against the floor covering or window sill. Also, the exposed bottom edge of the laminate is easily soiled, eventually detracting from the overall appearance of the vertical blind. Furthermore, warping of the laminate due to changes in temperature and humidity may cause buckling to occur near the free bottom edge, allowing the laminate to easily pull out from under the flanges.

Additionally, other vertical blind slats have transparent flanges which require the pattern on the decorative laminate to be matched with the pattern on adjacent vertical blind slats to ensure a uniform appearance. Matching fabrics with the necessary precision requires extra time and effort, and can often be unsuccessful. Also, that portion of the fabric not covered by the transparent flange eventually fades, and is aesthetically unappealing because it stands in contrast to the unfaded portion of the fabric visible under the transparent flange.

SUMMARY OF THE INVENTION

It is therefore an object of the present invention to provide a vertical blind slat which protects the bottom edge of a decorative insert attached to a backing from soiling and fraying.

Another object of the present invention is to provide a vertical blind slat which minimizes any separation between the decorative insert and the backing caused by warping near the bottom of the slat.

Yet another object of the present invention is to provide a vertical blind slat that eliminates the need for perfect matching of decorative inserts situated on adjacent backings.

Accordingly, a vertical blind slat according to the present invention is provided having a backing with flanges running along each of its side edges. A separate end piece also having a flange along one edge is connected to the backing. The flanges along the side edges and the end edge form a channel in which a decorative insert can be inserted. The end flange protects the edge of the decorative insert against fraying and soiling from the floor. The end flange also prevents buckling of the decorative insert by securing the bottom edge of the insert, as well as covering up any shrinkage of the decorative insert.

Each flange also has an opaque strip disposed along its length. The opaque strip disposed on the bottom flange provides a clean uniform line across the bottom of the vertical blind slats to provide a pleasing appearance. Additionally, the opaque strip on the vertical flanges eliminates the need to perfectly match the pattern on the decorative insert between adjacent slats by visually separating the inserts into discrete units.

BRIEF DESCRIPTION OF THE DRAWINGS

FIG. 1 is a perspective view of a conventional vertical blind arrangement including a series of slats according to the present invention;

FIG. 2 is an enlarged front view of the area designated 2 in FIG. 1;

FIG. 3 is a cross-sectional view of a slat taken along line 3—3 in FIG. 2; and FIG. 4 is a cross-sectional view of the slat taken along line 4—4 in FIG. 2.

DETAILED DESCRIPTION OF THE PREFERRED EMBODIMENT

FIG. 1 illustrates a plurality of louvers or slats 10 according to the present invention for a conventional vertical blind 11. As is well known in the art, each slat 10 is hung from a hook (not shown) under an overhang 12, and depends to a point closely adjacent the floor or window sill 13. As shown in FIGS. 2 through 4, each slat 10 comprises a backing 14, a pair of side flanges 16 and 18, an end piece 20, an end flange 22, and opaque strips 24, 26 and 27.

The backing 14 is preferably formed of a rigid plastic material such as an extruded polyvinyl chloride (PVC), and has a front side 28, a pair of opposite side edges 30 and 32, and an end edge 34. The side flanges 16 and 18 are disposed respectively along the side edges 30 and 32 of the backing 14. Each side flange 16 and 18 is integrally connected to the backing 14 and may be formed from a polyester film such as Mylar (TM, E.I. duPont) or a polycarbonate resin such as Lexan (TM, General Electric). Preferably, the flanges 16 and 18 and the backing 14 are coextruded. The backing 14 is curved during extrusion about its longitudinal axis as best shown in FIG. 3.

Both flanges 16 and 18 extend inwardly over the front side 28 of the backing 14 toward the opposite side edge of the backing. Channels 36 and 38 are thereby defined which are capable of receiving and holding opposite edges of a decorative insert 40. The side flanges 16 and 18 hold the sides of the insert 40 against the front side 28 of the backing 14, and also inhibit lateral or horizontal movement of the insert 40 relative to the backing 14. Similarly, the end flange 22 forms a channel 41 capable of receiving and holding a bottom edge 44 of the decorative insert 40. The end flange 22 prevents the decorative insert 40 from moving longitudinally past the bottom edge 34 of the backing 14.

The end piece 20 is preferably molded or extruded out of the same material as the backing 14, and is adhered or otherwise connected to a rear side 42 of the backing 14. Adhesion may be accomplished by using glue or a similar adhesive, or by using other known methods of bonding plastic materials. To enable the end piece 20 to more closely conform to the backing 14, the end piece 20 is preferably curved to match the curvature of the backing. The end piece 20 is, therefore, preferably subjected to controlled cooling temperatures along its underside during or immediately after extrusion. This cooling causes the material emerging from the extruder to tend to curl or coil up. The extruded piece is then chopped at the desired length to form the end piece 20 with a curvature approximating the longitudinal curvature of the backing 14.

The end flange 22 is integrally connected to the end piece 20 in a manner similar to the connection between the side flanges 16 and 18 and the backing 14. The end piece 20 is connected to the backing 14 such that the end flange 22 extends inwardly over the end edge 34 of the backing 14. The flange 22 and the flanges 16,18 are dimensioned so as to have the flange 22 be received in the channels formed by the side flanges 16 and 18 at their lower-most points. The end flange 22 protects the bottom of the decorative insert 40 from dirt and abrasives on the floor or window sill, and also provides a uniform appearance across the bottom of the vertical blind slat 10.

The opaque strips 24, 26 and 27 are disposed respectively along the inwardly facing portions of the side flanges 16 and 18 and the end flange 22. The opaque strips are scratch resistant and flexible, and are preferably a heat transfer metallic tape having an adhesive backing which permanently bonds to the flanges when applied thereto at temperatures of about 300°–325° F. A heat transfer tape suitable for this purpose has an aluminum strip vacuum sealed therein, and is available from CFC International Corporation of Chicago, Ill. As an alternative to a metallic tape adhered to the flanges, the opaque strips 24, 26 and 27 may be embedded in or laminated to the flanges 16, 18 and 22.

The decorative insert 40 is inserted in the channels 36 and 38 by sliding the insert 40 against the backing 14 from the top edge so that the side edges of the insert 40 are held underneath the flanges 16 and 18. The insert length is sufficient to insure that the bottom edge 44 of the insert is received in the channel 41 formed by the flange 22. The decorative insert 40 is preferably stiff enough to avoid bending or wrinkling when placed on top of the backing 14 and subsequently hung. The insert 40 may include a strip of fabric or wallpaper joined to a stiff material such as heavy grade paper or cardboard. The stiff material strengthens the fabric or wallpaper from underneath and, therefore, does not detract from the overall appearance of the insert 40.

As is well known in the art, after placing the decorative insert 40 into the channels 36 and 38, a slot (not shown) may be cut in the decorative insert in alignment with a slot in the top portion of the backing 14. To prevent longitudinal movement of the decorative insert 40 in relation to the backing 14, a hole may be cut through both the decorative insert 40 and the backing 14 and a rivet inserted therethrough. Attaching the decorative insert 40 to the backing 14 at a single point in this manner allows for unequal expansion and contraction of the decorative insert 40 without causing distortion of the slat 10. Additionally, the insert 40 can easily be changed as desired simply by removing the rivet and sliding the insert 40 off of the backing 14.

While the best mode for carrying out the invention has been described in detail, those familiar with the art to which this invention relates will recognize various alternative designs and embodiments for practicing the invention as defined by the following claims.

What is claimed is:

1. A slat for a vertical window blind comprising:

a backing having a front side, a pair of side edges and an end edge;

side flanges, each side edge having an associated side flange connected to the backing at the side edge and extending inwardly over the front side of the backing toward the opposite side edge;

an end piece having an end flange;

a plurality of opaque strips, each side flange and the end flange having an associated strip secured thereto; and means for securing the end piece to the backing so that the end flange extends inwardly over the end edge of the backing.

2. The slat of claim 1 wherein the side flanges and the end flange are dimensioned so as to have the end flange be received into channels formed by the side flanges.

3. The slat of claim 1 wherein the opaque strip is heat transfer metallic tape.

4. The slat of claim 1 further comprising a decorative insert having a pair of side edges and an end edge, the side edges of the decorative insert being held against the backing by the side flanges, the end edge of the decorative insert being held against the backing by the end flange.

5. The slat of claim 1 wherein the backing and the side flanges are coextruded.

6. The slat of claim 1 wherein the means for securing the end piece to the backing is glue between the end piece and a rear side of the backing.

7. The slat of claim 1 wherein the backing has a longitudinal axis, the backing being curved therealong.

8. A slat for a vertical blind, comprising:

a backing having a front side and a rear side and a pair of side edges;

side flanges, each side edge having an associated side flange integrally connected to the backing at the edge and extending inwardly over the front side of the backing toward the opposite side edge; and a plurality of opaque strips, each side flange having an associated strip secured thereto.

9. The slat of claim 8 wherein each opaque strip is heat transfer metallic tape.

10. The slat of claim 8 further comprising a decorative insert being held against the backing by the side flanges.

11. The slat of claim 8 wherein the flanges are coextruded.

12. A slat for a vertical blind comprising:

a backing having a front side and a rear side, a pair of side edges and an end edge;

side flanges, each side edge having an associated side flange integrally connected to the backing at the side edge and extending inwardly over the front side of the backing toward the opposite side edge;

an end place adhered to the rear side of the backing;

an end flange integrally connected to the end piece and extending inwardly over the end edge of the backing;

an opaque strip disposed along each side flange and disposed along the end flange; and a decorative insert having a pair of side edges and an end edge, the side edges of the decorative insert being held against the backing by the side flanges, the end edge of the decorative insert being held against the backing by the end flange, thereby securing the decorative insert to the backing.

13. A slat for a vertical window blind comprising:

a backing having a front side, a pair of side edges and an end edge;

side flanges, each side edge having an associated side flange connected to the backing at the side edge and extending inwardly over the front side of the backing toward the opposite side edge;

an end piece having an end flange; and means for securing the end piece to the backing so that the end flange extends inwardly over the end edge of the backing, the side flanges and the end flange being dimensioned so as to have the end flange received into channels formed by the side flanges.

14. The slat of claim 13 further comprising a plurality of opaque strips, each side flange and the end flange having an associated strip secured thereto.

15. The slat of claim 14 wherein each opaque trip is heat transfer metallic tape.

16. The slat of claim 13 further comprising a decorative insert having a pair of side edges and an end edge, the side edges of the decorative insert being held against the backing by the side flanges, the end edge of the decorative insert being held against the backing by the end flange.

17. The slat of claim 13 wherein the backing and the side flanges are coextruded.

18. The slat of claim 13 wherein the means for securing the end piece to the backing is glue between the end piece and a rear side of the backing.

19. The slat of claim 13 wherein the backing has a longitudinal axis, the backing being curved therealong.

* * * * *